US009631163B2

(12) United States Patent
Hulskotter et al.

(10) Patent No.: US 9,631,163 B2
(45) **Date of Patent: *Apr. 25, 2017**

(54) LIQUID LAUNDRY DETERGENT COMPOSITION

(71) Applicant: The Procter & Gamble Company, Cincinnati, OH (US)

(72) Inventors: Frank Hulskotter, Bad Duerkheim (DE); Stefano Scialla, Rome (IT); Brian Joseph Loughnane, Fairfield, OH (US); Amy Eichstadt Waun, West Chester, OH (US); Sophia Rosa Ebert, Mannheim (DE); Bjoern Ludolph, Ludwigshafen (DE); Christof Wigbers, Mannheim (DE); Steffen Maas, Bubenheim (DE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/496,131

(22) Filed: Sep. 25, 2014

(65) Prior Publication Data

US 2016/0090561 A1 Mar. 31, 2016

(51) Int. Cl.

| | |
|---|---|
| ***C11D 3/30*** | (2006.01) |
| ***C11D 3/37*** | (2006.01) |
| ***C11D 17/08*** | (2006.01) |
| ***C11D 17/04*** | (2006.01) |
| ***C11D 1/00*** | (2006.01) |
| ***C11D 3/32*** | (2006.01) |
| ***C11D 1/48*** | (2006.01) |

(52) U.S. Cl.

CPC ..... *C11D 3/3707* (2013.01); *C11D 1/00* (2013.01); *C11D 1/48* (2013.01); *C11D 3/30* (2013.01); *C11D 3/32* (2013.01); *C11D 3/3723* (2013.01); *C11D 17/042* (2013.01); *C11D 17/043* (2013.01); *C11D 17/044* (2013.01); *C11D 17/08* (2013.01)

(58) Field of Classification Search

CPC ..... C11D 1/00; C11D 3/32; C11D 3/3723; C11D 17/042; C11D 17/043; C11D 17/044

USPC ..... 510/350, 351, 352, 356, 357, 361, 476, 510/477, 499, 505, 506, 296, 439

See application file for complete search history.

(56) References Cited

U.S. PATENT DOCUMENTS

| | | | | |
|---|---|---|---|---|
| 3,654,370 | A | 4/1972 | Yeakey et al. | |
| 4,450,091 | A | 5/1984 | Schmolka | |
| 4,537,705 | A | 8/1985 | Mahoney et al. | |
| 4,556,509 | A | 12/1985 | Demangeon et al. | |
| 4,609,683 | A | 9/1986 | Grigsby, Jr. et al. | |
| 4,764,291 | A | 8/1988 | Steltenkamp et al. | |
| 4,820,436 | A | 4/1989 | Andree et al. | |
| 4,973,416 | A * | 11/1990 | Kennedy | C11D 3/30 510/296 |
| 5,317,076 | A | 5/1994 | Primeaux, II | |
| 5,571,286 | A | 11/1996 | Connell et al. | |
| 5,863,886 | A | 1/1999 | Tracy et al. | |
| 2,295,623 | A | 9/1999 | Baillely et al. | |
| 5,977,275 | A | 11/1999 | Rodrigues et al. | |
| 6,146,427 | A | 11/2000 | Crutcher | |
| 6,172,021 | B1 | 1/2001 | Ofosu-Asante et al. | |
| 6,172,024 | B1 | 1/2001 | Arvanitidou | |
| 6,191,099 | B1 | 2/2001 | Crutcher | |
| 6,347,055 | B1 | 2/2002 | Motomura | |
| 6,365,561 | B1 | 4/2002 | Vinson et al. | |
| 6,369,024 | B1 | 4/2002 | Panandiker et al. | |
| 6,437,055 | B1 | 8/2002 | Moriarity et al. | |
| 6,462,008 | B1 | 10/2002 | Ortiz et al. | |
| 6,506,716 | B1 | 1/2003 | Delplancke et al. | |
| 6,589,926 | B1 | 7/2003 | Vinson et al. | |
| 6,652,667 | B2 | 11/2003 | Ahmadi et al. | |
| 6,703,523 | B1 | 3/2004 | Rohrbaugh et al. | |
| 6,710,023 | B1 | 3/2004 | Bodet et al. | |
| 6,857,485 | B2 | 2/2005 | Patel et al. | |
| 6,951,710 | B2 | 10/2005 | Rieker et al. | |
| 7,037,883 | B2 | 5/2006 | Hsu et al. | |
| 7,387,992 | B2 | 6/2008 | Hsu et al. | |
| 7,816,481 | B2 | 10/2010 | Klein et al. | |
| 8,097,577 | B2 | 1/2012 | Danziger et al. | |
| 8,193,144 | B2 | 6/2012 | Tanner et al. | |
| 8,247,368 | B2 | 8/2012 | Danziger et al. | |
| 8,471,065 | B2 | 6/2013 | Burton et al. | |
| 8,586,039 | B2 | 11/2013 | Tsuchiya et al. | |
| 8,815,007 | B2 | 8/2014 | Tanner et al. | |
| 9,193,939 | B2 * | 11/2015 | Hulskotter | C11D 3/0036 |
| 2002/0147368 | A1 | 10/2002 | Li et al. | |

(Continued)

FOREIGN PATENT DOCUMENTS

| | | | |
|---|---|---|---|
| DE | 1643426 | A1 | 3/1979 |
| DE | 19854592 | A1 | 5/2000 |

(Continued)

OTHER PUBLICATIONS

U.S. Appl. No. 14/498,225, filed Sep. 26, 2014, Brian Joseph Loughnane, et al.

U.S. Appl. No. 14/496,577, filed Sep. 15, 2014, Brian Joseph Loughnane, et al.

U.S. Appl. No. 14/486,478, filed Sep. 15, 2014, Brian Joseph Loughnane, et al.

U.S. Appl. No. 14/496,151, filed Sep. 25, 2014, Brian Joseph Loughnane, et al.

International Search Report for PCT/US2014/031939, dated Jul. 7, 2014, containing 14 pages.

(Continued)

*Primary Examiner* — Gregory R Delcotto

(74) *Attorney, Agent, or Firm* — Gregory S. Darley-Emerson; Leonard W. Lewis; Steven W. Miller

(57) ABSTRACT

The present invention relates to liquid laundry detergent compositions comprising a polyetheramine.

8 Claims, No Drawings

(56) References Cited

U.S. PATENT DOCUMENTS

| | | | | |
|---|---|---|---|---|
| 2004/0186034 | A1* | 9/2004 | Verrall | C11D 17/043 510/296 |
| 2005/0027141 | A1 | 2/2005 | Furushima et al. | |
| 2006/0074004 | A1 | 4/2006 | Johnson et al. | |
| 2010/0323943 | A1 | 12/2010 | Evers et al. | |
| 2011/0009670 | A1 | 1/2011 | Renken et al. | |
| 2012/0259075 | A1 | 10/2012 | Klein et al. | |
| 2012/0309884 | A1 | 12/2012 | Walker et al. | |
| 2013/0291315 | A1 | 11/2013 | Bennett et al. | |
| 2014/0255330 | A1 | 9/2014 | Cron et al. | |
| 2014/0296124 | A1* | 10/2014 | Hulskotter | C11D 3/0036 510/300 |
| 2014/0296127 | A1 | 10/2014 | Hulskotter et al. | |
| 2015/0057212 | A1 | 2/2015 | Hulskotter et al. | |
| 2015/0275142 | A1 | 10/2015 | Hulskotter et al. | |
| 2015/0275144 | A1 | 10/2015 | Hulskotter et al. | |
| 2015/0315524 | A1* | 11/2015 | Hulskotter | C11D 3/3707 510/235 |

FOREIGN PATENT DOCUMENTS

| | | | | |
|---|---|---|---|---|
| EP | 1664254 | B9 | | 8/2004 |
| EP | 1436374 | B1 | | 8/2008 |
| GB | 581 994 | A | | 10/1946 |
| JP | 2011/0001504 | | | 1/2011 |
| WO | WO 86/07603 | | | 12/1986 |
| WO | WO 90/03423 | | | 4/1990 |
| WO | WO 97/30103 | | | 8/1997 |
| WO | WO98/28393 | | * | 7/1998 |
| WO | WO 98/28393 | | | 7/1998 |
| WO | WO 00/63334 | | | 10/2000 |
| WO | WO00/63334 | | * | 10/2000 |
| WO | WO 01/27232 | A1 | | 4/2001 |
| WO | WO01/76729 | | * | 10/2001 |
| WO | WO 01/76729 | A2 | | 10/2001 |
| WO | WO 01/83661 | A1 | | 11/2001 |
| WO | WO 2009/065738 | A3 | | 9/2009 |
| WO | WO 2012/126665 | A1 | | 9/2012 |

OTHER PUBLICATIONS

International Search Report for PCT/US2014/031941, dated Jul. 3, 2014, containing 14 pages.

International Search Report for PCT/US2014/051165, dated Dec. 1, 2014, containing 10 pages.

International Search Report for PCT/US2015/021968, dated Jul. 9, 2015, containing 11 pages.

www.huntsman.com/portal/page/.../jeffamine_polyetheramines, downloaded on Jun. 9, 2015 (PDF Attached).

International Search Report for PCT/US2015/021970, dated Jul. 8, 2015, containing 13 pages.

International Search Report for PCT/US2015/022927, dated Sep. 11, 2015, containing 12 pages.

International Search Report for PCT/US2015/052082, dated Dec. 17, 2015, containing 13 pages.

International Search Report for PCT/US2015/050074, dated Jan. 20, 2016, 14 pages.

International Search Report for PCT/US2015/051369, dated Jan. 27, 2016, 14 pages.

* cited by examiner

LIQUID LAUNDRY DETERGENT COMPOSITION

FIELD OF THE INVENTION

The present invention relates to liquid laundry detergent compositions comprising a polyetheramine.

BACKGROUND OF THE INVENTION

Due to the increasing popularity of easy-care fabrics made of synthetic fibers as well as the ever increasing energy costs and growing ecological concerns of detergent users, the once popular warm and hot water washes have now taken a back seat to washing fabrics in cold water (30° C. and below). Many commercially available laundry detergents are even advertised as being suitable for washing fabrics at 15° C. or even 9° C. To achieve satisfactory washing results at such low temperatures, results comparable to those obtained with hot-water washes, the demands on low-temperature detergents are especially high.

It is known to include certain additives in detergent compositions to enhance the detergent power of conventional surfactants, so as to improve the removal of grease stains at temperatures of 30° C. and below. For example, laundry detergents containing an aliphatic amine compound, in addition to at least one synthetic anionic and/or nonionic surfactant, are known. Also, the use of linear, alkyl-modified (secondary) alkoxypropylamines in laundry detergents to improve cleaning at low temperatures is known. These known laundry detergents, however, are unable to achieve satisfactory cleaning at cold temperatures.

Furthermore, the use of linear, primary polyoxyalkyleneamines (e.g., Jeffamine® D-230) to stabilize fragrances in laundry detergents and provide longer lasting scent is also known. Also, the use of high-moleculer-weight (molecular weight of at least about 1000), branched, trifunctional, primary amines (e.g., Jeffamine® T-5000 polyetheramine) to suppress suds in liquid detergents is known. Additionally, an etheramine mixture containing a monoether diamine (e.g., at least 10% by weight of the etheramine mixture), methods for its production, and its use as a curing agent or as a raw material in the synthesis of polymers are known. Finally, the use of compounds derived from the reaction of diamines or polyamines with alkylene oxides and compounds derived from the reaction of amine terminated polyethers with epoxide functional compounds to suppress suds is known.

There is a continuing need for a detergent additive that can improve cleaning performance at low wash temperatures, e.g., at 30° C. or even lower, without interfering with the production and the quality of the laundry detergents in any way. More specifically, there is a need for a detergent additive that can improve cold water grease cleaning, without adversely affecting particulate cleaning. Surprisingly, it has been found that the liquid laundry detergent compositions of the invention provide increased grease removal (particularly in cold water).

SUMMARY OF THE INVENTION

The present invention is to a water-soluble unit dose article comprising a water-soluble film and a liquid laundry detergent composition contained therein, where the liquid laundry detergent composition comprises: from about 0.1% to about 10% by weight of a polyetheramine of Formula (I), Formula (II), or a mixture thereof:

Formula (I)

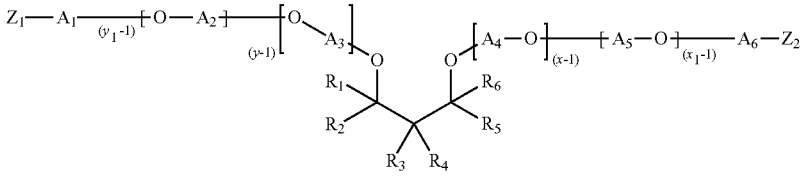

Formula (II)

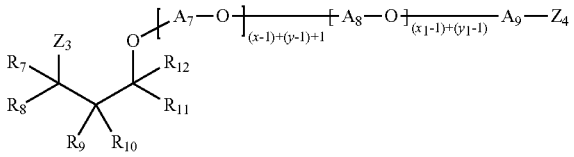

where each of $R_1$-$R_{12}$ is independently selected from H, alkyl, cycloalkyl, aryl, alkylaryl, or arylalkyl, where at least one of $R_1$-$R_6$ and at least one of $R_7$-$R_{12}$ is different from H, each of $A_1$-$A_9$ is independently selected from linear or branched alkylenes having 2 to 18 carbon atoms, each of $Z_1$-$Z_4$ is independently selected from OH or $NH_2$, where at least one of $Z_1$-$Z_2$ and at least one of $Z_3$-$Z_4$ is $NH_2$, where the sum of x+y is in the range of about 2 to about 200, where $x \geq 1$ and $y \geq 1$, and the sum of $x_1+y_1$ is in the range of about 2 to about 200, where $x_1 \geq 1$ and $y_1 \geq 1$.

DETAILED DESCRIPTION OF THE INVENTION

Features and benefits of the present invention will become apparent from the following description, which includes examples intended to give a broad representation of the invention. Various modifications will be apparent to those skilled in the art from this description and from practice of the invention. The scope is not intended to be limited to the particular forms disclosed and the invention covers all modifications, equivalents, and alternatives falling within the spirit and scope of the invention as defined by the claims.

As used herein, the articles including "the," "a" and "an" when used in a claim or in the specification, are understood to mean one or more of what is claimed or described.

As used herein, the terms "include," "includes" and "including" are meant to be non-limiting.

As used herein, the term "gallon" refers to a "US gallon."

The term "substantially free of" or "substantially free from" as used herein refers to either the complete absence of an ingredient or a minimal amount thereof merely as impurity or unintended byproduct of another ingredient. A composition that is "substantially free" of/from a component means that the composition comprises less than about 0.5%, 0.25%, 0.1%, 0.05%, or 0.01%, or even 0%, by weight of the composition, of the component.

As used herein, the term "soiled material" is used non-specifically and may refer to any type of flexible material consisting of a network of natural or artificial fibers, including natural, artificial, and synthetic fibers, such as, but not limited to, cotton, linen, wool, polyester, nylon, silk, acrylic, and the like, as well as various blends and combinations. Soiled material may further refer to any type of hard surface, including natural, artificial, or synthetic surfaces, such as, but not limited to, tile, granite, grout, glass, composite, vinyl, hardwood, metal, cooking surfaces, plastic, and the like, as well as blends and combinations.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

All cited patents and other documents are, in relevant part, incorporated by reference as if fully restated herein. The citation of any patent or other document is not an admission that the cited patent or other document is prior art with respect to the present invention.

In this description, all concentrations and ratios are on a weight basis of the detergent composition unless otherwise specified.

Composition

The present invention is to a liquid laundry detergent composition. The term 'liquid' encompasses aqueous compositions, non-aqueous compositions, gels, pastes, dispersions and the like. By laundry detergent composition, we herein mean a composition that can be used in a laundry wash and/or rinse operation. A laundry detergent composition can also be a laundry pretreatment composition.

The liquid laundry detergent composition may be present in a water-soluble unit dose article. In such an embodiment, the water-soluble unit dose article comprises at least one water-soluble film shaped such that the unit-dose article comprises at least one internal compartment surrounded by the water-soluble film. The at least one compartment comprises the liquid laundry detergent composition. The water-soluble film is sealed such that the liquid laundry detergent composition does not leak out of the compartment during storage. However, upon addition of the water-soluble unit dose article to water, the water-soluble film dissolves and releases the contents of the internal compartment into the wash liquor. The water-soluble unit dose article will be described in more detail below.

The liquid laundry detergent composition comprises a polyetheramine. Suitable polyetheramines are described in more detail below.

Polyetheramines

The liquid laundry detergent composition comprises a polyetheramine. The composition may comprise from about 0.1% to about 10%, or from about 0.2% to about 5%, or from about 0.5% to about 3%, by weight of the composition, of a polyetheramine.

The polyetheramine may be represented by the structure of Formula (I):

Formula (I)

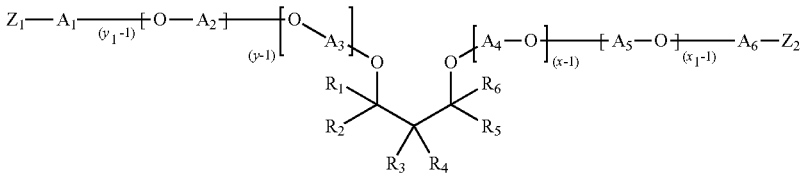

where each of $R_1$-$R_6$ is independently selected from H, alkyl, cycloalkyl, aryl, alkylaryl, or arylalkyl, where at least one of $R_1$-$R_6$ is different from H, typically at least one of $R_1$-$R_6$ is an alkyl group having 2 to 8 carbon atoms, each of $A_1$-$A_6$ is independently selected from linear or branched alkylenes having 2 to 18 carbon atoms, typically 2 to 10 carbon atoms, more typically, 2 to 5 carbon atoms, each of $Z_1$-$Z_2$ is independently selected from OH or $NH_2$, where at least one of $Z_1$-$Z_2$ is $NH_2$, typically each of $Z_1$ and $Z_2$ is $NH_2$, where the sum of x+y is in the range of about 2 to about 200, typically about 2 to about 20 or about 3 to about 20, more typically about 2 to about 10 or about 3 to about 8 or about 4 to about 6, where $x \geq 1$ and $y \geq 1$, and the sum of $x_1+y_1$ is in the range of about 2 to about 200, typically about 2 to about 20 or about 3 to about 20, more typically about 2 to about 10 or about 3 to about 8 or about 2 to about 4, where $x_1 \geq 1$ and $y_1 \geq 1$.

In the polyetheramine of Formula (I), each of $A_1$-$A_6$ may be independently selected from ethylene, propylene, or butylene, typically each of $A_1$-$A_6$ is propylene. In the polyetheramine of Formula (I), each of $R_1$, $R_2$, $R_5$, and $R_6$ may be H and each of $R_3$ and $R_4$ may be independently selected from C1-C16 alkyl or aryl. Each of $R_1$, $R_2$, $R_5$, and $R_6$ may be H and each of $R_3$ and $R_4$ may be independently selected from a butyl group, an ethyl group, a methyl group, a propyl group, or a phenyl group. In the polyetheramine of Formula (I), $R_3$ may be an ethyl group, each of $R_1$, $R_2$, $R_5$, and $R_6$ may be H, and $R_4$ may be a butyl group. In the polyetheramine of Formula (I), each of $R_1$ and $R_2$ may be H and each of $R_3$, $R_4$, $R_5$, and $R_6$ may be independently selected from an ethyl group, a methyl group, a propyl group, a butyl group, a phenyl group, or H.

The polyetheramine may be represented by the structure of Formula (II):

Formula (II)

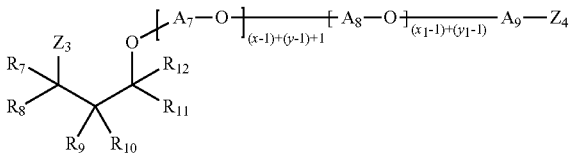

where each of $R_7$-$R_{12}$ is independently selected from H, alkyl, cycloalkyl, aryl, alkylaryl, or arylalkyl, where at least one of $R_7$-$R_{12}$ is different from H, typically at least one of $R_7$-$R_{12}$ is an alkyl group having 2 to 8 carbon atoms, each of $A_7$-$A_9$ is independently selected from linear or branched alkylenes having 2 to 18 carbon atoms, typically 2 to 10 carbon atoms, more typically, 2 to 5 carbon atoms, each of $Z_3$-$Z_4$ is independently selected from OH or $NH_2$, where at least one of $Z_3$-$Z_4$ is $NH_2$, typically each of $Z_3$ and $Z_4$ is $NH_2$, where the sum of x+y is in the range of about 2 to about 200, typically about 2 to about 20 or about 3 to about 20, more typically about 2 to about 10 or about 3 to about 8 or about 2 to about 4, where x≥1 and y≥1, and the sum of $x_1+y_1$ is in the range of about 2 to about 200, or about 2 to about 20 or about 3 to about 20, or about 2 to about 10 or about 3 to about 8 or about 2 to about 4, where $x_1 \geq 1$ and $y_1 \geq 1$.

In the polyetheramine of Formula (II), each of $A_7$-$A_9$ may be independently selected from ethylene, propylene, or butylene. Each of $A_7$-$A_9$ may be propylene. In the polyetheramine of Formula (II), each of $R_7$, $R_8$, $R_{11}$, and $R_{12}$ may be H and each of $R_9$ and $R_{10}$ may be independently selected from C1-C16 alkyl or aryl. Each of $R_7$, $R_8$, $R_{11}$, and $R_{12}$ may be H and each of $R_9$ and $R_{10}$ may be independently selected from a butyl group, an ethyl group, a methyl group, a propyl group, or a phenyl group. In the polyetheramine of Formula (II), $R_9$ may be an ethyl group, each of $R_7$, $R_8$, $R_{11}$, and $R_{12}$ may be H, and $R_{10}$ may be a butyl group. In the polyetheramine of Formula (II), each of $R_7$ and $R_8$ may be H and each of $R_9$, $R_{10}$, $R_{11}$, and $R_{12}$ may be independently selected from an ethyl group, a methyl group, a propyl group, a butyl group, a phenyl group, or H.

x, $x_1$, y, and/or $y_1$ may be independently equal to 3 or greater, meaning that the polyetheramine of Formula (I) may have more than one [$A_2$-O] group, more than one [$A_3$-O] group, more than one [$A_4$-O] group, and/or more than one [$A_5$-O] group. $A_2$ may be selected from ethylene, propylene, butylene, or mixtures thereof. $A_3$ may be selected from ethylene, propylene, butylene, or mixtures thereof. $A_4$ may be selected from ethylene, propylene, butylene, or mixtures thereof. $A_5$ may be selected from ethylene, propylene, butylene, or mixtures thereof.

Similarly, the polyetheramine of Formula (II) may have more than one [$A_7$-O] group and/or more than one [$A_8$-O] group. $A_7$ may be selected from ethylene, propylene, butylene, or mixtures thereof. $A_8$ may be selected from ethylene, propylene, butylene, or mixtures thereof.

[$A_2$-O] may be selected from ethylene oxide, propylene oxide, butylene oxide, or mixtures thereof. [$A_3$-O] may be selected from ethylene oxide, propylene oxide, butylene oxide, or mixtures thereof. [$A_4$-O] may be selected from ethylene oxide, propylene oxide, butylene oxide, or mixtures thereof. [$A_5$-O] may be selected from ethylene oxide, propylene oxide, butylene oxide, or mixtures thereof. [$A_7$-O] may be selected from ethylene oxide, propylene oxide, butylene oxide, or mixtures thereof. [$A_8$-O] may be selected from ethylene oxide, propylene oxide, butylene oxide, or mixtures thereof.

When $A_2$, $A_3$, $A_4$, and/or $A_5$ are mixtures of ethylene, propylene, and/or butylenes, the resulting alkoxylate may have a block-wise structure or a random structure. When $A_7$ and/or $A_8$ are mixtures of ethylene, propylene, and/or butylenes, the resulting alkoxylate may have a block-wise structure or a random structure.

For a non-limiting illustration, when x=7 in the polyetheramine according to Formula (I), then the polyetheramine comprises six [$A_4$-O] groups. If $A_4$ comprises a mixture of ethylene groups and propylene groups, then the resulting polyetheramine would comprise a mixture of ethoxy (EO) groups and propoxy (PO) groups. These groups may be arranged in a random structure (e.g., EO-EO-PO-EO-PO-PO) or a block-wise structure (EO-EO-EO-PO-PO-PO). In this illustrative example, there are an equal number of different alkoxy groups (here, three EO and three PO), but there may also be different numbers of each alkoxy group (e.g., five EO and one PO). Furthermore, when the polyetheramine comprises alkoxy groups in a block-wise structure, the polyetheramine may comprise two blocks, as shown in the illustrative example (where the three EO groups form one block and the three PO groups form another block), or the polyetheramine may comprise more than two blocks. The above discussion also applies to polyethermines according to Formula (II).

The polyetheramine may be selected from the group consisting of Formula B, Formula C, and mixtures thereof:

Formula B

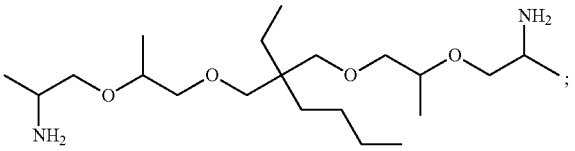

Formula C

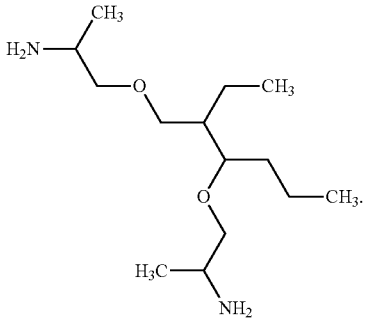

The polyetheramine may comprise a mixture of the compound of Formula (I) and the compound of Formula (II).

The polyetheramine of Formula (I) or Formula (II) may have a weight average molecular weight of about 290 to about 1000 grams/mole, or about 300 to about 700 grams/mole, or about 300 to about 450 grams/mole. The molecular mass of a polymer differs from typical molecules in that polymerization reactions produce a distribution of molecular weights, which is summarized by the weight average molecular weight. The polyetheramine polymers of the invention are thus distributed over a range of molecular weights. Differences in the molecular weights are primarily attributable to differences in the number of monomer units that sequence together during synthesis. With regard to the polyetheramine polymers of the invention, the monomer units are the alkylene oxides that react with the 1,3-diols of formula (III) to form alkoxylated 1,3-diols, which are then aminated to form the resulting polyetheramine polymers. The resulting polyetheramine polymers are characterized by the sequence of alkylene oxide units. The alkoxylation reaction results in a distribution of sequences of alkylene oxide and, hence, a distribution of molecular weights. The alkoxylation reaction also produces unreacted alkylene oxide monomer ("unreacted monomers") that do not react during the reaction and remain in the composition.

The polyetheramine may comprise a polyetheramine mixture comprising at least 90%, by weight of the polyetheramine mixture, of the polyetheramine of Formula (I), the polyetheramine of Formula (II), or a mixture thereof. The polyetheramine may comprise a polyetheramine mixture comprising at least 95%, by weight of the polyetheramine mixture, of the polyetheramine of Formula (I), the polyetheramine of Formula (II), or a mixture thereof.

The polyetheramine of Formula (I) and/or the polyetheramine of Formula (II) are obtainable by:

a) reacting a 1,3-diol of formula (III) with a $C_2$-$C_{18}$ alkylene oxide to form an alkoxylated 1,3-diol, wherein the molar ratio of 1,3-diol to $C_2$-$C_{18}$ alkylene oxide is in the range of about 1:2 to about 1:10, (III)

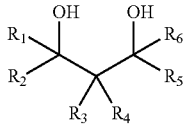

where $R_1$-$R_6$ are independently selected from H, alkyl, cycloalkyl, aryl, alkylaryl, or arylalkyl, where at least one of $R_1$-$R_6$ is different from H;

b) aminating the alkoxylated 1,3-diol with ammonia.

The molar ratio of 1,3-diol to $C_2$-$C_{18}$ alkylene oxide may be in the range of about 1:3 to about 1:8, or in the range of about 1:4 to about 1:6. The $C_2$-$C_{18}$ alkylene oxide may be selected from ethylene oxide, propylene oxide, butylene oxide or a mixture thereof. The $C_2$-$C_{18}$ alkylene oxide may be propylene oxide.

In the 1,3-diol of formula (III), $R_1$, $R_2$, $R_5$, and $R_6$ may be H and $R_3$ and $R_4$ may be $C_{1-16}$ alkyl or aryl. The 1,3-diol of formula (III) may be selected from 2-butyl-2-ethyl-1,3-propanediol, 2-methyl-2-propyl-1,3-propanediol, 2-methyl-2-phenyl-1,3-propanediol, 2,2-dimethyl-1,3-propandiol, 2-ethyl-1,3-hexandiol, or a mixture thereof.

Step a): Alkoxylation

The 1,3-diols of Formula III are synthesized as described in WO10026030, WO10026066, WO09138387, WO09153193, and WO10010075. Suitable 1,3-diols include 2,2-dimethyl-1,3-propane diol, 2-butyl-2-ethyl-1,3-propane diol, 2-pentyl-2-propyl-1,3-propane diol, 2-(2-methyl)butyl-2-propyl-1,3-propane diol, 2,2,4-trimethyl-1,3-propane diol, 2,2-diethyl-1,3-propane diol, 2-methyl-2-propyl-1,3-propane diol, 2-ethyl-1,3-hexane diol, 2-phenyl-2-methyl-1,3-propane diol, 2-methyl-1,3-propane diol, 2-ethyl-2-methyl-1,3 propane diol, 2,2-dibutyl-1,3-propane diol, 2,2-di(2-methylpropyl)-1,3-propane diol, 2-isopropyl-2-methyl-1,3-propane diol, or a mixture thereof. The 1,3-diol may be selected from 2-butyl-2-ethyl-1,3-propanediol, 2-methyl-2-propyl-1,3-propanediol, 2-methyl-2-phenyl-1,3-propanediol, or a mixture thereof. Typically used 1,3-diols are 2-butyl-2-ethyl-1,3-propanediol, 2-methyl-2-propyl-1,3-propanediol, 2-methyl-2-phenyl-1,3-propanediol.

An alkoxylated 1,3-diol may be obtained by reacting a 1,3-diol of Formula III with an alkylene oxide, according to any number of general alkoxylation procedures known in the art. Suitable alkylene oxides include $C_2$-$C_{18}$ alkylene oxides, such as ethylene oxide, propylene oxide, butylene oxide, pentene oxide, hexene oxide, decene oxide, dodecene oxide, or a mixture thereof. The $C_2$-$C_{18}$ alkylene oxide may be selected from ethylene oxide, propylene oxide, butylene oxide, or a mixture thereof. A 1,3-diol may be reacted with a single alkylene oxide or combinations of two or more different alkylene oxides. When using two or more different alkylene oxides, the resulting polymer may be obtained as a block-wise structure or a random structure.

The molar ratio of 1,3-diol to $C_2$-$C_{18}$ alkylene oxide at which the alkoxylation reaction is carried out may be in the range of about 1:2 to about 1:10, or about 1:3 to about 1:8, or about 1:4 to about 1:6.

The alkoxylation reaction generally proceeds in the presence of a catalyst in an aqueous solution at a reaction temperature of from about 70° C. to about 200° C. and typically from about 80° C. to about 160° C. The reaction may proceed at a pressure of up to about 10 bar or up to about 8 bar. Examples of suitable catalysts include basic catalysts, such as alkali metal and alkaline earth metal hydroxides, e.g., sodium hydroxide, potassium hydroxide and calcium hydroxide, alkali metal alkoxides, in particular sodium and potassium $C_1$-$C_4$-alkoxides, e.g., sodium methoxide, sodium ethoxide and potassium tert-butoxide, alkali metal and alkaline earth metal hydrides, such as sodium hydride and calcium hydride, and alkali metal carbonates, such as sodium carbonate and potassium carbonate. The catalyst may be an alkali metal hydroxide, typically potassium hydroxide or sodium hydroxide. Typical use amounts for the catalyst are from about 0.05 to about 10% by weight, in particular from about 0.1 to about 2% by weight, based on the total amount of 1,3-diol and alkylene oxide. During the alkoxylation reaction, certain impurities—unintended constituents of the polymer—may be formed, such as catalysts residues.

Alkoxylation with x+y $C_2$-$C_{18}$ alkylene oxides and/or $x_1$+$y_1$ $C_2$-$C_{18}$ alkylene oxides produces structures as represented by Formula IV and/or Formula V:

Formula (IV)

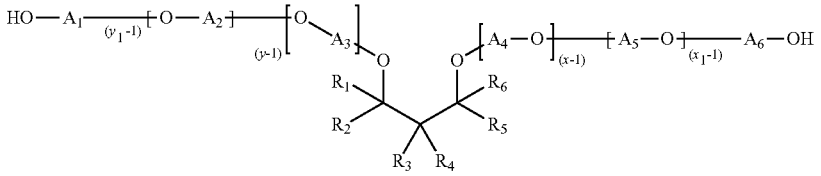

-continued

Formula (V)

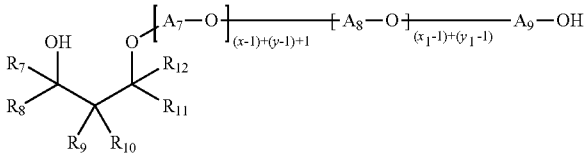

where $R_1$-$R_{12}$ are independently selected from H, alkyl, cycloalkyl, aryl, alkylaryl, or arylalkyl, where at least one of $R_1$-$R_6$ and at least one of $R_7$-$R_{12}$ is different from H, each of $A_1$-$A_9$ is independently selected from linear or branched alkylenes having 2 to 18 carbon atoms, typically 2 to 10 carbon atoms, more typically 2 to 5 carbon atoms, and the sum of x+y is in the range of about 2 to about 200, typically about 2 to about 20 or about 3 to about 20, more typically about 2 to about 10 or about 2 to about 5, where x≥1 and y≥1, and the sum of $x_1+y_1$ is in the range of about 2 to about 200, typically about 2 to about 20 or about 3 to about 20, more typically about 2 to about 10 or about 2 to about 5, where $x_1 \geq 1$ and $y_1 \geq 1$.

Step b): Amination

Amination of the alkoxylated 1,3-diols produces structures represented by Formula I or Formula II:

Formula I

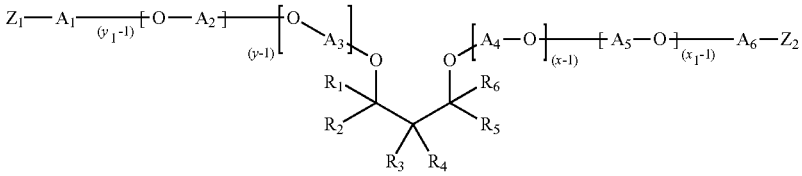

Formula (II)

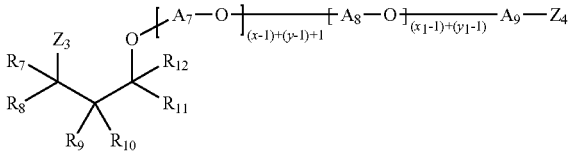

where each of $R_1$-$R_{12}$ is independently selected from H, alkyl, cycloalkyl, aryl, alkylaryl, or arylalkyl, where at least one of $R_1$-$R_6$ and at least one of $R_7$-$R_{12}$ is different from H, each of $A_1$-$A_9$ is independently selected from linear or branched alkylenes having 2 to 18 carbon atoms, typically 2 to 10 carbon atoms, more typically, 2 to 5 carbon atoms, each of $Z_1$-$Z_4$ is independently selected from OH or $NH_2$, where at least one of $Z_1$-$Z_2$ and at least one of $Z_3$-$Z_4$ is $NH_2$, where the sum of x+y is in the range of about 2 to about 200, typically about 2 to about 20 or about 3 to about 20, more typically about 2 to about 10 or about 2 to about 5, where x≥1 and y≥1, and the sum of $x_1+y_1$ is in the range of about 2 to about 200, typically about 2 to about 20 or about 3 to about 20, more typically about 2 to about 10 or about 2 to about 5, where $x_1 \geq 1$ and $y_1 \geq 1$.

Polyetheramines according to Formula I and/or Formula II are obtained by reductive amination of the alkoxylated 1,3-diol mixture (Formula IV and Formula V) with ammonia in the presence of hydrogen and a catalyst containing nickel. Suitable catalysts are described in WO 2011/067199A1, WO2011/067200A1, and EP0696572 B1. Preferred catalysts are supported copper-, nickel-, and cobalt-containing catalysts, where the catalytically active material of the catalyst, before the reduction thereof with hydrogen, comprises oxygen compounds of aluminum, copper, nickel, and cobalt, and, in the range of from about 0.2 to about 5.0% by weight of oxygen compounds, of tin, calculated as SnO. Other suitable catalysts are supported copper-, nickel-, and cobalt-containing catalysts, where the catalytically active material of the catalyst, before the reduction thereof with hydrogen, comprises oxygen compounds of aluminum, copper, nickel, cobalt and tin, and, in the range of from about 0.2 to about 5.0% by weight of oxygen compounds, of yttrium, lanthanum, cerium and/or hafnium, each calculated as $Y_2O_3$, $La_2O_3$, $Ce_2O_3$ and $Hf_2O_3$, respectively. Another suitable catalyst is a zirconium, copper, and nickel catalyst, where the catalytically active composition comprises from about 20 to about 85% by weight of oxygen-containing zirconium compounds, calculated as $ZrO_2$, from about 1 to about 30% by weight of oxygen-containing compounds of copper, calculated as CuO, from about 30 to about 70% by weight of oxygen-containing compounds of nickel, calculated as NiO, from about 0.1 to about 5% by weight of oxygen-containing compounds of aluminium and/or manganese, calculated as $Al_2O_3$ and $MnO_2$ respectively.

For the reductive amination step, a supported as well as non-supported catalyst may be used. The supported catalyst is obtained, for example, by deposition of the metallic components of the catalyst compositions onto support materials known to those skilled in the art, using techniques which are well-known in the art, including without limitation, known forms of alumina, silica, charcoal, carbon, graphite, clays, mordenites; and molecular sieves, to provide supported catalysts as well. When the catalyst is supported, the support particles of the catalyst may have any geometric shape, for example spheres, tablets, or cylinders, in a regular or irregular version. The process may be carried out in a continuous or discontinuous mode, e.g. in an autoclave, tube reactor, or fixed-bed reactor. The feed thereto may be upflowing or downflowing, and design features in the reactor which optimize plug flow in the reactor may be employed. The degree of amination is from about 50% to about 100%, typically from about 60% to about 100%, and more typically from about 70% to about 100%.

The degree of amination is calculated from the total amine value (AZ) divided by sum of the total acetylables value (AC) and tertiary amine value (tert. AZ) multiplied by 100: (Total AZ: (AC+tert. AZ))×100). The total amine value (AZ) is determined according to DIN 16945. The total acetylables value (AC) is determined according to DIN 53240. The secondary and tertiary amine are determined according to ASTM D2074-07.

The hydroxyl value is calculated from (total acetylables value+tertiary amine value)−total amine value.

The polyetheramines of the invention are effective for removal of stains, particularly grease, from soiled material. Liquid laundry detergent compositions containing the amine-terminated polyalkylene glycols of the invention also do not exhibit the cleaning negatives seen with conventional amine-containing cleaning compositions on hydrophilic bleachable stains, such as coffee, tea, wine, or particulates. Additionally, unlike conventional amine-containing cleaning compositions, the amine-terminated polyalkylene glycols of the invention do not contribute to whiteness negatives on white fabrics.

The polyetheramines of the invention may be used in the form of a water-based, water-containing, or water-free solution, emulsion, gel or paste of the polyetheramine together with an acid such as, for example, citric acid, lactic acid, sulfuric acid, methanesulfonic acid, hydrogen chloride, e.g., aqueous hydrogen chloride, phosphoric acid, or mixtures thereof. Alternatively, the acid may be represented by a surfactant, such as, alkyl benzene sulphonic acid, alkylsulphonic acid, monoalkyl esters of sulphuric acid, mono alkylethoxy esters of sulphuric acid, fatty acids, alkyl ethoxy carboxylic acids, and the like, or mixtures thereof. When applicable or measurable, the preferred pH of the solution or emulsion ranges from pH 3 to pH 11, or from pH 6 to pH 9.5, even more preferred from pH 7 to pH 8.5.

A further advantage of liquid laundry detergent compositions containing the polyetheramines of the invention is their ability to remove grease stains in cold water. Without being limited by theory, it is believed that cold water washing solutions have the effect of hardening or solidifying grease, making the grease more resistant to removal, especially on fabric. Detergent compositions containing the polyetheramines of the invention are surprisingly effective when used as part of a pretreatment regimen followed by cold water washing.

Solvent

The liquid laundry detergent composition may comprise a solvent. It was surprisingly found that the stability of the opacifier was further improved when a solvent was also formulated into the laundry detergent composition.

The solvent may be selected from the group comprising, glycerol, p-diol, dipropylene glycol, polypropylene glycol, diethylene glycol, ethanol, isopropanol, butenol and mixtures thereof.

Adjunct Ingredients

The liquid laundry detergent composition of the present invention may comprise one or more adjunct ingredients. Suitable adjunct ingredients include, but are not limited to bleach, bleach catalyst, dye, hueing agents, cleaning polymers, alkoxylated polyamines, polyethyleneimines, alkoxylated polyethyleneimines, soil release polymers, surfactants, solvents, dye transfer inhibitors, chelants, enzymes, perfumes, encapsulated perfumes, perfume delivery agents, suds suppressor, brighteners, polycarboxylates, structurants, deposition aids and mixtures thereof.

The liquid laundry detergent composition may comprise less than 50%, or even less than 40% or even less than 30% by weight of water. The liquid laundry detergent composition may comprise from 1% to 30%, or even from 2% to 20% or even from 3% to 15% by weight of the composition of water.

Water-Soluble Unit Dose Article

The liquid laundry detergent composition may be present in a water-soluble unit dose article. In such an embodiment, the water-soluble unit dose article comprises at least one water-soluble film shaped such that the unit-dose article comprises at least one internal compartment surrounded by the water-soluble film. The at least one compartment comprises the liquid laundry detergent composition. The water-soluble film is sealed such that the liquid laundry detergent composition does not leak out of the compartment during storage. However, upon addition of the water-soluble unit dose article to water, the water-soluble film dissolves and releases the contents of the internal compartment into the wash liquor.

The compartment should be understood as meaning a closed internal space within the unit dose article, which holds the composition. Preferably, the unit dose article comprises a water-soluble film. The unit dose article is manufactured such that the water-soluble film completely surrounds the composition and in doing so defines the compartment in which the composition resides. The unit dose article may comprise two films. A first film may be shaped to comprise an open compartment into which the composition is added. A second film is then laid over the first film in such an orientation as to close the opening of the compartment. The first and second films are then sealed together along a seal region. The film is described in more detail below.

The unit dose article may comprise more than one compartment, even at least two compartments, or even at least three compartments. The compartments may be arranged in superposed orientation, i.e. one positioned on top of the other. Alternatively, the compartments may be positioned in a side-by-side orientation, i.e. one orientated next to the other. The compartments may even be orientated in a 'tyre and rim' arrangement, i.e. a first compartment is positioned next to a second compartment, but the first compartment at least partially surrounds the second compartment, but does not completely enclose the second compartment. Alternatively one compartment may be completely enclosed within another compartment.

Wherein the unit dose article comprises at least two compartments, one of the compartments may be smaller than the other compartment. Wherein the unit dose article comprises at least three compartments, two of the compartments may be smaller than the third compartment, and preferably the smaller compartments are superposed on the larger compartment. The superposed compartments preferably are orientated side-by-side.

In a multi-compartment orientation, the composition according to the present invention may be comprised in at least one of the compartments. It may for example be comprised in just one compartment, or may be comprised in two compartments, or even in three compartments.

The film of the present invention is soluble or dispersible in water. The water-soluble film preferably has a thickness of from 20 to 150 micron, preferably 35 to 125 micron, even more preferably 50 to 110 micron, most preferably about 76 micron.

Preferably, the film has a water-solubility of at least 50%, preferably at least 75% or even at least 95%, as measured by the method set out here after using a glass-filter with a maximum pore size of 20 microns:

50 grams±0.1 gram of film material is added in a pre-weighed 400 ml beaker and 245 ml±1 ml of distilled water is added. This is stirred vigorously on a magnetic stirrer, Labline model No. 1250 or equivalent and 5 cm magnetic stirrer, set at 600 rpm, for 30 minutes at 24° C. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersability can be calculated.

Preferred film materials are preferably polymeric materials. The film material can, for example, be obtained by casting, blow-moulding, extrusion or blown extrusion of the polymeric material, as known in the art.

Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%. The polymer can have any weight average molecular weight, preferably from about 1000 to 1,000,000, more preferably from about 10,000 to 300,000 yet more preferably from about 20,000 to 150,000.

Mixtures of polymers can also be used as the pouch material. This can be beneficial to control the mechanical and/or dissolution properties of the compartments or pouch, depending on the application thereof and the required needs. Suitable mixtures include for example mixtures wherein one polymer has a higher water-solubility than another polymer, and/or one polymer has a higher mechanical strength than another polymer. Also suitable are mixtures of polymers having different weight average molecular weights, for example a mixture of PVA or a copolymer thereof of a weight average molecular weight of about 10,000-40,000, preferably around 20,000, and of PVA or copolymer thereof, with a weight average molecular weight of about 100,000 to 300,000, preferably around 150,000. Also suitable herein are polymer blend compositions, for example comprising hydrolytically degradable and water-soluble polymer blends such as polylactide and polyvinyl alcohol, obtained by mixing polylactide and polyvinyl alcohol, typically comprising about 1-35% by weight polylactide and about 65% to 99% by weight polyvinyl alcohol. Preferred for use herein are polymers which are from about 60% to about 98% hydrolysed, preferably about 80% to about 90% hydrolysed, to improve the dissolution characteristics of the material.

Preferred films exhibit good dissolution in cold water, meaning unheated distilled water. Preferably such films exhibit good dissolution at temperatures of 24° C., even more preferably at 10° C. By good dissolution it is meant that the film exhibits water-solubility of at least 50%, preferably at least 75% or even at least 95%, as measured by the method set out here after using a glass-filter with a maximum pore size of 20 microns, described above.

Preferred films are those supplied by Monosol under the trade references M8630, M8900, M8779, M8310, films described in U.S. Pat. No. 6,166,117 and U.S. Pat. No. 6,787,512 and PVA films of corresponding solubility and deformability characteristics. Further preferred films are those described in US2006/0213801, WO 2010/119022, US2011/0188784, and U.S. Pat. No. 6,787,512.

Of the total PVA resin content in the film described herein, the PVA resin can comprise about 30 to about 85 wt % of the first PVA polymer, or about 45 to about 55 wt % of the first PVA polymer. For example, the PVA resin can contain about 50 w. % of each PVA polymer, wherein the viscosity of the first PVA polymer is about 13 cP and the viscosity of the second PVA polymer is about 23 cP.

Naturally, different film material and/or films of different thickness may be employed in making the compartments of the present invention. A benefit in selecting different films is that the resulting compartments may exhibit different solubility or release characteristics.

The film material herein can also comprise one or more additive ingredients. For example, it can be beneficial to add plasticisers, for example glycerol, ethylene glycol, diethyleneglycol, propylene glycol, sorbitol and mixtures thereof. Other additives may include water and functional detergent additives, including surfactant, to be delivered to the wash water, for example organic polymeric dispersants, etc.

The film may be opaque, transparent or translucent. The film may comprise a printed area. The printed area may cover between 10 and 80% of the surface of the film; or between 10 and 80% of the surface of the film that is in contact with the internal space of the compartment; or between 10 and 80% of the surface of the film and between 10 and 80% of the surface of the compartment.

The area of print may cover an uninterrupted portion of the film or it may cover parts thereof, i.e. comprise smaller areas of print, the sum of which represents between 10 and 80% of the surface of the film or the surface of the film in contact with the internal space of the compartment or both.

The area of print may comprise inks, pigments, dyes, blueing agents or mixtures thereof. The area of print may be opaque, translucent or transparent.

The area of print may comprise a single colour or maybe comprise multiple colours, even three colours. The area of print may comprise white, black, blue, red colours, or a mixture thereof. The print may be present as a layer on the surface of the film or may at least partially penetrate into the film. The film will comprise a first side and a second side. The area of print may be present on either side of the film, or be present on both sides of the film. Alternatively, the area of print may be at least partially comprised within the film itself.

The area of print may comprise an ink, wherein the ink comprises a pigment. The ink for printing onto the film has preferably a desired dispersion grade in water. The ink may be of any color including white, red, and black. The ink may be a water-based ink comprising from 10% to 80% or from 20% to 60% or from 25% to 45% per weight of water. The ink may comprise from 20% to 90% or from 40% to 80% or from 50% to 75% per weight of solid.

The ink may have a viscosity measured at 20° C. with a shear rate of 1000 $s^{-1}$ between 1 and 600 cPs or between 50 and 350 cPs or between 100 and 300 cPs or between 150 and 250 cPs. The measurement may be obtained with a cone-plate geometry on a TA instruments AR-550 Rheometer.

The area of print may be achieved using standard techniques, such as flexographic printing or inkjet printing. Preferably, the area of print is achieved via flexographic printing, in which a film is printed, then moulded into the shape of an open compartment. This compartment is then filled with a detergent composition and a second film placed over the compartment and sealed to the first film. The area of print may be on either or both sides of the film.

Alternatively, an ink or pigment may be added during the manufacture of the film such that all or at least part of the film is coloured.

The film may comprise an aversive agent, for example a bittering agent. Suitable bittering agents include, but are not limited to, naringin, sucrose octaacetate, quinine hydrochloride, denatonium benzoate, or mixtures thereof. Any suitable level of aversive agent may be used in the film. Suitable levels include, but are not limited to, 1 to 5000 ppm, or even 100 to 2500 ppm, or even 250 to 2000 rpm.

Process of Making

Any suitable process can be used to make the composition of the present invention. Those skilled in the art will know suitable process known the art.

Method of Use

The composition or unit dose article of the present invention can be added to a wash liquor to which h laundry is already present, or to which laundry is added. It may be used in an washing machine operation and added directly to the drum or to the dispenser drawer. The washing machine may be an automatic or semi-automatic washing machine. It may be used in combination with other laundry detergent compositions such as fabric softeners or stain removers. It may be used as pre-treat composition on a stain prior to being added to a wash liquor.

EXAMPLES

In the following examples, the individual ingredients within the cleaning compositions are expressed as percentages by weight of the cleaning compositions.

Synthesis Examples

Example 1

1 mol 2-Butyl-2-ethyl-1,3-propane diol+4 mol propylene oxide/OH, aminated a) 1 mol 2-Butyl-2-ethyl-1,3-propane diol+4 mol propylene oxide/OH In a 2 l autoclave 322.6 g 2-Butyl-2-ethyl-1,3-propane diol and 7.9 g KOH (50% in water) are mixed and stirred under vacuum (<10 mbar) at 120° C. for 2 h. The autoclave is purged with nitrogen and heated to 140° C. 467.8 g propylene oxide is added in portions within 6 h. To complete the reaction, the mixture is allowed to post-react for additional 5 h at 140° C. The reaction mixture is stripped with nitrogen and volatile compounds are removed in vacuo at 80° C. The catalyst potassium hydroxide is removed by adding 2.3 g synthetic magnesium silicate (Macrosorb MP5plus, Ineos Silicas Ltd.), stirring at 100° C. for 2 h and filtration. A yellowish oil is obtained (772.0 g, hydroxy value: 248.5 mgKOH/g).

b) 1 mol 2-Butyl-2-ethyl-1,3-propane diol+4 mol propylene oxide/OH, aminated

In a 9 l autoclave 600 g of the resulting diol mixture from example 1-a, 1250 g THF and 1500 g ammonia are mixed in presence of 200 ml of a solid catalyst as described in EP0696572B1. The catalyst containing nickel, cobalt, copper, molybdenum and zirconium is in the form of 3×3 mm tables. The autoclave is purged with hydrogen and the reaction is started by heating the autoclave. The reaction mixture is stirred for 18 h at 205° C., the total pressure is maintained at 270 bar by purging hydrogen during the entire reductive amination step. After cooling down the autoclave the final product is collected, filtered, vented of excess ammonia and stripped in a rotary evaporator to remove light amines and water. A total of 560 grams of a low-color etheramine mixture is recovered. The analytical results thereof are shown in Table 1.

TABLE 1

| Total amine-value mg KOH/g | Total acetylatables mg KOH/g | Secondary and tertiary amine value mg KOH/g | Tertiary amine-value mg KOH/g | Hydroxyl value mg KOH/g | Degree of amination in % | Primary Amine in % of total amine |
|---|---|---|---|---|---|---|
| 277.66 | 282.50 | 4.54 | 0.86 | 5.70 | 98.59 | 98.36 |

Example 2

1 mol 2,2,4-Trimethyl-1,3-propane diol+4 mol propylene oxide, aminated a) 1 mol 2,2,4-Trimethyl-1,3-propane diol+4 mol propylene oxide 327.3 g molten 2,2,4-Trimethyl-1,3-pentane diol and 8.5 g KOH (50% in water) are dewatered for 2 h at 80° C. and <10 mbar in a 2 l autoclave. The autoclave is purged with nitrogen and heated to 140° C. 519.4 g propylene oxide is added in portions within 6 h. To complete the reaction, the mixture is allowed to post-react for additional 5 h at 140° C. The reaction mixture is stripped with nitrogen and volatile compounds are removed in vacuo at 80° C. The catalyst is removed by adding 2.5 g Macrosorb MP5plus, stirring at 100° C. for 2 h and filtration. A yellowish oil is obtained (825.0 g, hydroxy value: 172.3 mgKOH/g).

b) 1 mol 2,2,4-Trimethyl-1,3-propane diol+4 mol propylene oxide, aminated

In a 9 l autoclave 700 g of the resulting diol mixture from example 2-a, 1000 mL THF and 1500 g Ammonia are mixed in presence of 200 ml of a solid catalyst as described in EP0696572B1. The catalyst containing nickel, cobalt, copper, molybdenum and zirconium is in the form of 3×3 mm tables. The autoclave is purged with hydrogen and the reaction is started by heating the autoclave. The reaction mixture is stirred for 15 h at 205° C., the total pressure is maintained at 280 bar by purging hydrogen during the entire reductive amination step. After cooling down the autoclave the final product is collected, filtered, vented of excess ammonia and stripped in a rotary evaporator to remove light amines and water. A total of 670 grams of a low-color etheramine mixture is recovered. The analytical results thereof are shown in Table 2.

TABLE 2

| Total amine-value mg KOH/g | Total acetylatables mg KOH/g | Secondary and tertiary amine value mg KOH/g | Tertiary amine-value mg KOH/g | Hydroxyl value mg KOH/g | Degree of amination in % | Primary Amine in % of total amine |
|---|---|---|---|---|---|---|
| 179.70 | 224.80 | 0.45 | 0.21 | 45.31 | 79.86 | 99.75 |

Example 3

1 mol 2,2-Diethyl-1,3-propane diol+4 mol propylene oxide, aminated a) 1 mol 2,2-Diethyl-1,3-propane diol+4 mol propylene oxide 197.4 g molten 2,2-diethyl-1,3-propane diol and 5.4 g KOH (50% in water) are dewatered for 2 h at 80° C. and <10 mbar in a 2 l autoclave. The autoclave is purged with nitrogen and heated to 140° C. 346.4 g propylene oxide is added in portions within 4 h. To complete the reaction, the mixture is allowed to post-react for additional 5 h at 140° C. The reaction mixture is stripped with nitrogen and volatile compounds are removed in vacuo at 80° C. The catalyst is removed by adding 1.6 g Macrosorb MP5plus, stirring at 100° C. for 2 h and filtration. A yellowish oil is obtained (530.0 g, hydroxy value: 267.8 mgKOH/g).

b) 1 mol 2,2-Diethyl-1,3-propane diol+4 mol propylene oxide, aminated

In a 9 l autoclave 500 g of the resulting diol mixture from example 3-a, 1200 ml THF and 1500 g Ammonia are mixed in presence of 200 ml of a solid catalyst as described in EP0696572B1. The catalyst containing nickel, cobalt, copper, molybdenum and zirconium is in the form of 3×3 mm tables. The autoclave is purged with hydrogen and the reaction is started by heating the autoclave. The reaction mixture is stirred for 15 h at 205° C., the total pressure is maintained at 270 bar by purging hydrogen during the entire reductive amination step. After cooling down the autoclave the final product is collected, filtered, vented of excess ammonia and stripped in a rotary evaporator to remove light amines and water. A total of 470 grams of a low-color etheramine mixture is recovered. The analytical results thereof are shown in Table 3.

TABLE 3

| Total amine-value mg KOH/g | Total acetylatables mg KOH/g | Secondary and tertiary amine value mg KOH/g | Tertiary amine-value mg KOH/g | Hydroxyl value mg KOH/g | Degree of amination in % | Primary Amine in % of total amine |
|---|---|---|---|---|---|---|
| 292.40 | 300.88 | 3.78 | 0.72 | 9.20 | 96.95 | 98.71 |

Example 4

1 mol 2-Methyl-2-propyl-1,3-propandiol+4 mol propylene oxide, aminated a) 1 mol 2-Methyl-2-propyl-1,3-propanediol+4 mol propylene oxide 198.3 g molten 2-methyl-2-propyl-1,3-propanediol and 5.5 g KOH (50% in water) are dewatered for 2 h at 80° C. and <10 mbar in a 2 l autoclave. The autoclave is purged with nitrogen and heated to 140° C. 348.0 g propylene oxide is added in portions within 4 h. To complete the reaction, the mixture is allowed to post-react for additional 5 h at 140° C. The reaction mixture is stripped with nitrogen and volatile compounds are removed in vacuo at 80° C. The catalyst is removed by adding 1.6 g Macrosorb MP5plus, stirring at 100° C. for 2 h and filtration. A yellowish oil is obtained (520.0 g, hydroxy value: 308.1 mgKOH/g).

b) 1 mol 2-Methyl-2-propyl-1,3-propanediol+4 mol propylene oxide, aminated

In a 9 l autoclave 500 g of the resulting diol mixture from example 4-a, 1200 ml THF and 1500 g ammonia are mixed in presence of 200 ml of a solid catalyst as described in EP0696572B1. The catalyst containing nickel, cobalt, copper, molybdenum and zirconium is in the form of 3×3 mm tables. The autoclave is purged with hydrogen and the reaction is started by heating the autoclave. The reaction mixture is stirred for 15 h at 205° C., the total pressure is maintained at 270 bar by purging hydrogen during the entire reductive amination step. After cooling down the autoclave the final product is collected, filtered, vented of excess ammonia and stripped in a rotary evaporator to remove light amines and water. A total of 470 grams of a low-color etheramine mixture is recovered. The analytical results thereof are shown in Table 4.

TABLE 4

| Total amine-value mg KOH/g | Total acetylatables mg KOH/g | Secondary and tertiary amine value mg KOH/g | Tertiary amine-value mg KOH/g | Hydroxyl value mg KOH/g | Degree of amination in % | Primary Amine in % of total amine |
|---|---|---|---|---|---|---|
| 292.45 | 301.76 | 3.01 | 1.33 | 10.64 | 96.49 | 98.97 |

Example 5

1 mol 2-Ethyl-1,3-hexane diol+4 mol propylene oxide, aminated a) 1 mol 2-Ethyl-1,3-hexane diol+4 mol propylene oxide

A 2 l autoclave is charged with 290.6 g molten 2-Ethyl-1,3-hexane diol and 7.5 g KOH (50% in water). The mixture is dewatered for 2 h at 90° C. and <10 mbar. The autoclave is purged with nitrogen and heated to 140° C. 461.1 g propylene oxide is added in portions within 4 h. To complete the reaction, the mixture is stirred for additional 5 h at 140° C. The reaction mixture is stripped with nitrogen and volatile compounds are removed in vacuo at 80° C. The catalyst is removed by adding 2.3 g Macrosorb MP5plus, stiffing at 100° C. for 2 h and filtration. A yellowish oil is obtained (745.0 g, hydroxy value: 229.4 mgKOH/g).

b) 1 mol 2-Ethyl-1,3-hexane diol+4 mol propylene oxide, aminated

In a 9 l autoclave 750 g of the resulting diol mixture from example 5-a, 950 ml THF and 1500 g Ammonia are mixed in presence of 200 ml of a solid catalyst as described in EP0696572B1. The catalyst containing nickel, cobalt, copper, molybdenum and zirconium is in the form of 3×3 mm tables. The autoclave is purged with hydrogen and the reaction is started by heating the autoclave. The reaction mixture is stirred for 15 h at 205° C., the total pressure is maintained at 270 bar by purging hydrogen during the entire reductive amination step. After cooling down the autoclave the final product is collected, filtered, vented of excess ammonia and stripped in a rotary evaporator to remove light amines and water. A total of 710 grams of a low-color etheramine mixture is recovered. The analytical results thereof are shown in Table 5.

TABLE 5

| Total amine-value mg KOH/g | Total acetylatables mg KOH/g | Secondary and tertiary amine value mg KOH/g | Tertiary amine-value mg KOH/g | Hydroxyl value mg KOH/g | Degree of amination in % | Primary Amine in % of total amine |
|---|---|---|---|---|---|---|
| 288.21 | 301.10 | 3.32 | 0.50 | 13.39 | 95.56 | 98.85 |

Example 6

1 mol 2-Phenyl-2-methyl-1,3-propane diol+4 mol propylene oxide, aminated a) 1 mol 2-Phenyl-2-methyl-1,3-propane diol+4 mol propylene oxide

A 2 l autoclave is charged with 298.4 g 2-Phenyl-2-methyl-1,3-propane diol and 7.1 g KOH (50% in water) and heated to 120° C. The mixture is dewatered for 2 h at 120° C. and <10 mbar. The autoclave is purged with nitrogen and heated to 140° C. 408.6 g propylene oxide is added in portions within 4 h. To complete the reaction, the mixture is stirred for additional 5 h at 140° C. The reaction mixture is stripped with nitrogen and volatile compounds are removed in vacuo at 80° C. The catalyst is removed by adding 2.1 g Macrosorb MP5plus, stiffing at 100° C. for 2 h and filtration. A yellowish oil is obtained (690.0 g, hydroxy value: 266.1 mgKOH/g).

b) 1 mol 2-Phenyl-2-methyl-1,3-propane diol+4 mol propylene oxide, aminated In a 9 l autoclave 600 g of the resulting diol mixture from example 6-a, 1100 ml THF and 1500 g Ammonia are mixed in presence of 200 ml of a solid catalyst as described in EP0696572B1. The catalyst containing nickel, cobalt, copper, molybdenum and zirconium is in the form of 3×3 mm tables. The autoclave is purged with hydrogen and the reaction is started by heating the autoclave. The reaction mixture is stirred for 15 h at 205° C., the total pressure is maintained at 270 bar by purging hydrogen during the entire reductive amination step. After cooling down the autoclave the final product is collected, filtered, vented of excess ammonia and stripped in a rotary evaporator to remove light amines and water. A total of 570 grams of a low-color etheramine mixture is recovered. The analytical results thereof are shown in Table 6.

TABLE 6

| Total amine-value mg KOH/g | Total acetylatables mg KOH/g | Secondary and tertiary amine value mg KOH/g | Tertiary amine-value mg KOH/g | Hydroxyl value mg KOH/g | Degree of amination in % | Primary Amine in % of total amine |
|---|---|---|---|---|---|---|
| 281.80 | 287.50 | 2.91 | 0.47 | 6.17 | 97.86 | 98.97 |

Example 7

1 mol 2,2-Dimethyl-1,3-propane diol+4 mol propylene oxide, aminated a) 1 mol 2,2-Dimethyl-1,3-propane diol+4 mol propylene oxide A 2 l autoclave is charged with 208.3 g 2,2-Dimethyl-1,3-propane diol and 1.34 g potassium tert.-butylate and heated to 120° C. The autoclave is purged with nitrogen and heated to 140° C. 464 g propylene oxide is added in portions within 6 h. To complete the reaction, the mixture is stirred for additional 5 h at 140° C. The reaction mixture is stripped with nitrogen and volatile compounds are removed in vacuo at 80° C. The catalyst is removed by adding 1.1 g Macrosorb MP5plus, stirring at 100° C. for 2 h and filtration. A light yellowish oil is obtained (650.0 g, hydroxy value: 308.6 mgKOH/g).

b) 1 mol 2,2-Dimethyl-1,3-propane diol+4 mol propylene oxide, aminated

In a 9 l autoclave 500 g of the resulting diol mixture from example 6-a, 1200 ml THF and 1500 g Ammonia are mixed in presence of 200 ml of a solid catalyst as described in EP0696572B1. The catalyst containing nickel, cobalt, copper, molybdenum and zirconium is in the form of 3×3 mm tables. The autoclave is purged with hydrogen and the reaction is started by heating the autoclave. The reaction mixture is stirred for 15 h at 205° C., the total pressure is maintained at 280 bar by purging hydrogen during the entire reductive amination step. After cooling down the autoclave the final product is collected, filtered, vented of excess ammonia and stripped in a rotary evaporator to remove light amines and water. A total of 450 grams of a low-color etheramine mixture is recovered. The analytical results thereof are shown in Table 7.

TABLE 7

| Total amine-value mg KOH/g | Total acetylatables mg KOH/g | Secondary and tertiary amine value mg KOH/g | Tertiary amine-value mg KOH/g | Hydroxyl value mg KOH/g | Degree of amination in % | Primary Amine in % of total amine |
|---|---|---|---|---|---|---|
| 329.86 | 338.00 | 1.66 | 0.90 | 9.04 | 97.33 | 99.50 |

Example 8

1 mol 2-butyl-2-ethyl-1,3-propanediol+5.6 mol propylene oxide, aminated a) 1 mol 2-butyl-2-ethyl-1,3-propanediol+5.6 mol propylene oxide In a 2 l autoclave 313.1 g 2-Butyl-2-ethyl-1,3-propanediol and 3.8 g KOH (50% in water) are mixed and stirred under vacuum (<10 mbar) at 120° C. for 2 h. The autoclave is purged with nitrogen and heated to 140° C. 635.6 g propylene oxide is added in portions within 6 h. To complete the reaction, the mixture is allowed to post-react for additional 5 h at 140° C. The reaction mixture is stripped with nitrogen and volatile compounds are removed in vacuo at 80° C. The catalyst is removed by adding 50.9 g water and 8.2 g phosphoric acid (40% in water) stirring at 100° C. for 0.5 h and dewatering in vacuo for 2 hours. After filtration, 930.0 g of light yellowish oil is obtained (hydroxy value: 190 mgKOH/g).

b) 1 mol 2-butyl-2-ethyl-1,3-propanediol+5.6 mol propylene oxide, aminated

The amination of 8a (1 mol 2-butyl-2-ethyl-1,3-propanediol+5.6 mole propylene oxide) is conducted in a tubular reactor (length 500 mm, diameter 18 mm) which had been charged with 15 mL of silica (3×3 mm pellets) followed by 70 mL (74 g) of the catalyst precursor (containing oxides of nickel, cobalt, copper and tin on gamma-$Al_2O_3$, 1.0-1.6 mm split—prepared according to WO 2013/072289 A1) and filled up with silica (ca. 15 mL).

The catalyst is activated at atmospheric pressure by being heated to 100° C. with 25 Nl/h of nitrogen, then 3 hours at 150° C. in which the hydrogen feed is increased from 2 to 25 Nl/h, then heated to 280° C. at a heating rate of 60° C. per hour and kept at 280° C. for 12 hours. The reactor is cooled to 100° C., the nitrogen flow is turned off and the pressure is increased to 120 bar. The catalyst is flushed with ammonia at 100° C., before the temperature is increased to 206° C. and the alcohol feed is started with a WHSV of 0.19 kg/liter*h (molar ratio ammonia/alcohol=55:1, hydrogen/alcohol=11.6:1). The crude material is collected and stripped on a rotary evaporator to remove excess ammonia, light weight amines and reaction water to afford 8b (1 mol 2-butyl-2-ethyl-1,3-propanediol+5.6 mole propylene oxide, aminated). The analytical data of the reaction product is shown in Table 8.

TABLE 8

| Total amine-value mg KOH/g | Total acetylatables mg KOH/g | Secondary and tertiary amine value mg KOH/g | Tertiary amine-value mg KOH/g | Hydroxyl value mg KOH/g | Grade of amination in % | Primary Amine in % of total amine |
|---|---|---|---|---|---|---|
| 222.92 | 231.50 | 2.57 | 0.31 | 8.89 | 96.16 | 98.85 |

Example 9

Comparative Grease Stain Removal from Single Unit Dose Laundry Detergents

The following laundry detergent compositions are prepared by traditional means known to those of ordinary skill in the art by mixing the listed ingredients. Composition A is a single unit laundry detergent (nil-polyetheramine). Composition B is a single unit laundry detergent that contains Baxxodur® EC301. Detergent composition C is a single unit laundry detergent that contains a polyetheramine of Example 1 (see e.g., Formula B above).

TABLE 9

| | Composition A % | Composition B % | Composition C % |
|---|---|---|---|
| Anionic Surfactant HF LAS[1] | 18.2 | 18.2 | 18.2 |
| C14-15 alkyl ethoxy (2.5) sulfate | 8.73 | 8.73 | 8.73 |
| C14-15 alkyl ethoxy (3.0) sulfate | 0.87 | 0.87 | 0.87 |
| Nonionic Surfactant C24-9[2] | 15.5 | 15.5 | 15.5 |
| TC Fatty acid[15] | 6.0 | 6.0 | 6.0 |
| Citric Acid | 0.6 | 0.6 | 0.6 |
| FN3 protease[3] | 0.027 | 0.027 | 0.027 |
| FNA protease [4] | 0.071 | 0.071 | 0.071 |
| Natalase[5] | 0.009 | 0.009 | 0.009 |
| Termamyl Ultra[6] | 0.002 | 0.002 | 0.002 |
| Mannanase [7] | 0.004 | 0.004 | 0.004 |
| PEI ethoxylate dispersant[9] | 5.9 | 5.9 | 5.9 |
| RV-base[10] | 1.5 | 1.5 | 1.5 |
| DTPA[11] | 0.6 | 0.6 | 0.6 |
| EDDS[12] | 0.5 | 0.5 | 0.5 |
| Fluorescent Whitening Agent 49 | 0.1 | 0.1 | 0.1 |
| 1,2 propylene diol | 15.3 | 15.3 | 15.3 |
| Glycerol | 4.9 | 4.9 | 4.9 |
| Monoethanolamine | 6.6 | 6.6 | 6.6 |
| NaOH | 0.1 | 0.1 | 0.1 |
| Sodium Bisulfite | 0.3 | 0.3 | 0.3 |
| Calcium Formate | 0.08 | 0.08 | 0.08 |
| Polyethylene Glycol (PEG) 4000 | 0.1 | 0.1 | 0.1 |
| Fragrance | 1.6 | 1.6 | 1.6 |
| Dyes | 0.01 | 0.01 | 0.01 |
| Baxxodur ® EC301 | — | 1.0 | — |
| Polyetheramine[14] | — | — | 1.0 |
| Water | TO BALANCE 100% | TO BALANCE 100% | TO BALANCE 100% |

[1]Linear Alkyl Benzene Sasol, Lake Charles, LA

[2]AE9 is C12-13 alcohol ethoxylate, with an average degree of ethoxylation of 9, supplied by Huntsman, Salt Lake City, Utah, USA

[3]Protease supplied by Genencor International, Palo Alto, California, USA (e.g. Purafect Prime ®)

[4] Protease supplied by Genencor International, Palo Alto, California, USA

[5]Natalase ® supplied by Novozymes, Bagsvaerd, Denmark

[6]Termamyl Ultra supplied by Novozymes, Bagsvaerd, Denmark

[7] Mannanase ® supplied by Novozymes, Bagsvaerd, Denmark

8. Whitezyme supplied by Novozymes, Bagsvaerd, Denmark

TABLE 9-continued

| | Composition A % | Composition B % | Composition C % |
|---|---|---|---|

[9]Polyethyleneimine (MW = 600) with 20 ethoxylate groups per —NH

[10]Sokalan 101 Polyethyleneglycol-Polyvinylacetate copolymer dispersant supplied by BASF

[11]Suitable chelants are, for example, diethylenetetraamine pentaacetic acid (DTPA) supplied by Dow Chemical, Midland, Michigan, USA

[12]Ethylenediaminedisuccinic acid supplied by Innospec Englewood, Colorado, USA 13. Suitable Fluorescent Whitening Agents are for example, Tinopal ® AMS, Tinopal ® CBS-X, Sulphonated zinc phthalocyanine Ciba Specialty Chemicals, Basel, Switzerland

[14]Polyetheramine of Example 1, 1 mol 2-Butyl-2-ethyl-1,3-propane diol + 4 mol propylene oxide/OH, aminated.

[15]Topped Coconut Fatty Acid Twin Rivers Technologies Quincy Massachusetts

Technical stain swatches of CW120 cotton containing Margarine, Bacon Grease, Burnt Butter, Hamburger Grease and Taco Grease are purchased from Empirical Manufacturing Co., Inc (Cincinnati, Ohio). The swatches are washed in a Miele front loader washing machine, using 6 grains per gallon water hardness and washed at 60° F. Fahrenheit Automatic Cold Wash cycle. The total amount of liquid detergent used in the test is 25.36 grams.

Standard colorimetric measurement is used to obtain L*, a* and b* values for each stain before and after the washing. From L*, a* and b* values the stain level is calculated. The stain removal index is then calculated according to the SRI formula shown above. Eight replicates of each stain type are prepared. The SRI values shown below are the averaged SRI values for each stain type.

TABLE 10

Stain Removal Data

| | Composition A (SRI) | Composition B (SRI) | Composition C (SRI) | LSD |
|---|---|---|---|---|
| Margarine | 77.8 | 81.8 | 87.0 | 2.94 |
| Grease bacon | 69.7 | 71.8 | 73.8 | 5.06 |
| Grease burnt butter | 78.1 | 80.2 | 83.4 | 2.15 |
| Grease hamburger | 65.0 | 68.3 | 72.0 | 3.30 |
| Grease taco | 64.5 | 66.9 | 70.7 | 3.15 |
| Average | 71.0 | 73.8 | 77.4 | |

These results illustrate the surprising grease removal benefit of a single unit laundry detergent composition that contains a polyetheramine of the present disclosure (as used in Composition C), as compared to a single unit laundry detergent composition that contains Baxxodur® EC301 (Composition B) and a conventional single unit laundry detergent composition (nil-polyetheramine), especially on difficult-to-remove, high-frequency consumer stains like margarine, burnt butter and taco grease.

Example 10

Unit Dose Compositions

This Example provides various formulations for unit dose laundry detergents. Such unit dose formulations can comprise one or multiple compartments.

The following unit dose laundry detergent formulations of the present invention are provided below.

TABLE 11

| Unit Dose Compositions | | | | | |
|---|---|---|---|---|---|
| Ingredients | 1 | 2 | 3 | 4 | 5 |
| Alkylbenzene sulfonic acid C 11-13, 23.5% 2-phenyl isomer | 14.5 | 14.5 | 14.5 | 14.5 | 14.5 |
| $C_{12-14}$ alkyl ethoxy 3 sulfate | 7.5 | 7.5 | 7.5 | 7.5 | 7.5 |
| $C_{12-14}$ alkyl 7-ethoxylate | 13.0 | 13.0 | 13.0 | 13.0 | 13.0 |
| Citric Acid | 0.6 | 0.6 | 0.6 | 0.6 | 0.6 |
| Fatty Acid | 14.8 | 14.8 | 14.8 | 14.8 | 14.8 |
| Enzymes (as % raw material not active) | 1.7 | 1.7 | 1.7 | 1.7 | 1.7 |
| Protease (as % active) | 0.05 | 0.1 | 0.02 | 0.03 | 0.03 |
| Ethoxylated Polyethylenimine[1] | 4.0 | 4.0 | 4.0 | 4.0 | 4.0 |
| Polyetheramine[2] | 1.0 | 2.0 | 1.0 | 2.0 | 2.0 |
| Hydroxyethane diphosphonic acid | 1.2 | 1.2 | 1.2 | 1.2 | 1.2 |
| Brightener | 0.3 | 0.3 | 0.3 | 0.3 | 0.3 |
| P-diol | 15.8 | 13.8 | 13.8 | 13.8 | 13.8 |
| Glycerol | 6.1 | 6.1 | 6.1 | 6.1 | 6.1 |
| MEA | 8.0 | 8.0 | 8.0 | 8.0 | 8.0 |
| TIPA | — | — | 2.0 | — | — |
| TEA | — | 2.0 | — | — | — |
| Cumene sulphonate | — | — | — | — | 2.0 |
| cyclohexyl dimethanol | — | — | — | 2.0 | — |
| Water | 10 | 10 | 10 | 10 | 10 |
| Structurant | 0.14 | 0.14 | 0.14 | 0.14 | 0.14 |
| Perfume | 1.9 | 1.9 | 1.9 | 1.9 | 1.9 |
| Buffers (monoethanolamine) | | | To pH 8.0 | | |
| Solvents (1,2 propanediol, ethanol) | | | To 100% | | |

[1]Polyethylenimine (MW = 600) with 20 ethoxylate groups per —NH.
[2]Polyetheramine of Example 1, 2, 3, 4, 5, 6, 7, or 8.

-continued

| Base Composition 1 | |
|---|---|
| Ingredients | % |
| Citric Acid | 0.5 |
| Monoethanolamine | 10.0 |
| Caustic soda | — |
| Hydroxyethane diphosphonic acid | 1.1 |
| Potassium sulfite | 0.2 |
| Nonionic Marlipal $C24EO_7$ | 20.1 |
| HLAS[1] | 24.6 |
| Fluorescent Brightener 2[3] | 0.2 |
| C12-15 Fatty acid | 16.4 |
| A compound having the following general structure: bis($(C_2H_5O)(C_2H_4O)n)(CH_3)$—$N^+$—$C_xH_{2x}$—$N^+$—$(CH_3)$-bis($(C_2H_5O)(C_2H_4O)n$), wherein n = from 20 to 30, and x = from 3 to 8, or sulphated or sulphonated variants thereof | 2.9 |
| Polyethyleneimine ethoxylate PEI600 E20 | 1.1 |
| Polyetheramine[2] | 1 |
| $MgCl_2$ | 0.2 |
| Solvents (1,2 propanediol, ethanol) | To 100% |

[1]Linear alkylbenzenesulfonate having an average aliphatic carbon chain length $C_{11}$-$C_{12}$ supplied by Stepan, Northfield, Illinois, USA.
[2]Polyetheramine of Example 1, 2, 3, 4, 5, 6, 7, or 8.
[3]Fluorescent Brightener 2 is Tinopal ® CBS-X, supplied by Ciba Specialty Chemicals, Basel, Switzerland.

| Multi-compartment formulations | | | | | | |
|---|---|---|---|---|---|---|
| Composition | 1 | | | 2 | | |
| Compartment | A | B | C | A | B | C |
| Volume of each compartment | 40 ml | 5 ml | 5 ml | 40 ml | 5 ml | 5 ml |
| Active material in Wt. % | | | | | | |
| Perfume | 1.6 | 1.6 | 1.6 | 1.6 | 1.6 | 1.6 |
| Dyes | <0.01 | <0.01 | <0.01 | <0.01 | <0.01 | <0.01 |
| TiO2 | 0.1 | — | — | — | 0.1 | — |
| Sodium Sulfite | 0.4 | 0.4 | 0.4 | 0.3 | 0.3 | 0.3 |
| Acusol 305, Rohm&Haas | 1.2 | | | 2 | — | — |
| Hydrogenated castor oil | 0.14 | 0.14 | 0.14 | 0.14 | 0.14 | 0.14 |
| Base Composition 1 | Add to 100% | Add to 100% | Add to 100% | Add to 100% | Add to 100% | Add to 100% |

Example 11

Multiple Compartment Unit Dose Compositions

In this example the unit dose has three compartments, but similar compositions can be made with two or more compartments. The film used to encapsulate the compartments is polyvinyl alcohol.

| Base Composition 1 | |
|---|---|
| Ingredients | % |
| Glycerol | 5.3 |
| 1,2-propanediol | 10.0 |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

"Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern."

"While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention."

What is claimed is:

1. A water-soluble unit dose article comprising a water-soluble film and a liquid laundry detergent composition comprising: from about 0.1% to about 10% of a polyetheramine of Formula (I), or a mixture thereof:

Formula (I)

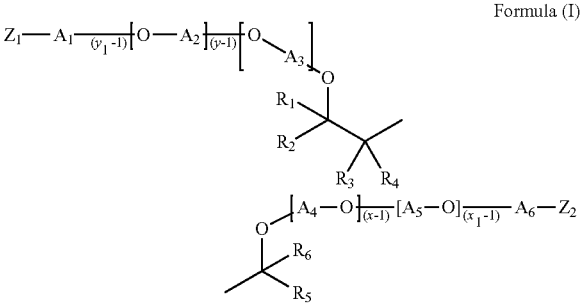

wherein each of $R_1$, $R_2$, $R_5$, and $R_6$ is H and each of $R_3$ and $R_4$ is independently selected from a butyl group, an ethyl group, a methyl group, or a propyl group; each of $A_1$-$A_5$ is independently selected from ethylene, propylene, or butylene; each of $Z_1$-$Z_2$ is independently selected from OH or $NH_2$, wherein at least one of $Z_1$-$Z_2$ is $NH_2$, wherein the sum of x+y is in the range of 2 to about 8, wherein x≥1 and y≥1, and the sum of $x_1+y_1$ is in the range of 2 to about 8, wherein $x_1 \geq 1$ and $y_1 \geq 1$.

2. The water-soluble unit dose article of claim 1 wherein in said polyetheramine of Formula (I), each of $Z_1$-$Z_2$ is $NH_2$.

3. The water-soluble unit dose article of claim 1 wherein in said polyetheramine of Formula (I), each of $A_1$-$A_5$ is propylene.

4. The water-soluble unit dose article of claim 1 wherein in said polyetheramine of Formula (I), $R_3$ is an ethyl group, and $R_4$ is a butyl group.

5. The water-soluble unit dose article of claim 1 wherein said polyetheramine has a weight average molecular weight of about 290 to about 1000 grams/mole.

6. The water-soluble unit dose article of claim 5 wherein said polyetheramine has a weight average molecular weight of about 300 to about 450 grams/mole.

7. The water-soluble unit dose article of claim 1 wherein said liquid laundry detergent composition comprises an adjunct material and wherein the adjunct material is selected from the group consisting of bleach, bleach catalyst, dye, hueing agents, cleaning polymers, alkoxylated polyamines, polyethyleneimines, alkoxylated polyethyleneimines, soil release polymers, surfactants, solvents, dye transfer inhibitors, chelants, enzymes, perfumes, encapsulated perfumes, perfume delivery agents, suds suppressor, brighteners, polycarboxylates, structurants, deposition aids and mixtures thereof.

8. The water-soluble unit dose article of claim 1 wherein said liquid laundry detergent composition comprises a solvent selected from the group consisting of glycerol, p-diol, dipropylene glycol, polypropylene glycol, diethylene glycol, ethanol, isopropanol, butenol, and mixtures thereof.

* * * * *